US007150554B2

(12) United States Patent
Calderas

(10) Patent No.: US 7,150,554 B2
(45) Date of Patent: Dec. 19, 2006

(54) DARK LOOK LED AUTOMOTIVE LIGHTING

(75) Inventor: Jeffrey Jose Calderas, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 202 days.

(21) Appl. No.: 10/748,660

(22) Filed: Dec. 31, 2003

(65) Prior Publication Data

US 2005/0146887 A1 Jul. 7, 2005

(51) Int. Cl.
*F21V 21/00* (2006.01)

(52) U.S. Cl. ..... 362/545; 362/509; 362/520; 362/540

(58) Field of Classification Search ..... 362/545, 362/540–542, 509, 516, 520; 315/76–78
See application file for complete search history.

(56) References Cited

U.S. PATENT DOCUMENTS 5,172,972 A * 12/1992 Terao ..... 362/517
6,220,733 B1 * 4/2001 Gordon ..... 362/500
2002/0149312 A1 * 10/2002 Roberts et al. ..... 313/495

* cited by examiner

*Primary Examiner*—Sandra O'Shea
*Assistant Examiner*—Mark Tsidulko
(74) *Attorney, Agent, or Firm*—Laura C. Hargitt

(57) ABSTRACT

Automotive lamps are configured having at least one array of light emitting diodes (LEDs) supported within the lamps. A bezel is positioned in each lamp adjacent to the LEDs, the bezel having a dark surface, the dark surface having a high gloss finish with reflector shaped surfaces to reflect light from the LEDs while absorbing visible light from external sources. A lens of light transmitting material covers the array of LEDs. The automotive lamp is especially useful as a rear combination lamp having red LEDs serving both tail light and stop light functions, as well as amber or red LEDs providing turn and hazard signals. A center, high-mounted stop lamp (CHMSL), also using an array of LEDs surrounded by a dark bezel with high gloss reflector shaped surfaces, is used in combination with a pair of the rear combination lamps. In one embodiment the rear combination lamps include side marker LEDs.

8 Claims, 10 Drawing Sheets

DARK LOOK LED AUTOMOTIVE LIGHTING

FIELD OF THE INVENTION

The present invention is directed to dark look LED automotive lighting. More particularly, the present invention is directed to dark look LED automotive lighting, used as but not limited to external signal lighting.

BACKGROUND OF THE INVENTION

Automobile manufacturers are constantly improving vehicles by improving reliability, improving performance and developing devices which may be useful in succeeding generations of vehicles. As an aspect of vehicle design, automotive lighting evolves as vehicles improve. As automotive lighting evolves, there is a general need to minimize power consumption and to enhance performance and reliability, while at least maintaining and perhaps improving conspicuity. With respect to automotive lighting, it is important to have lighting schemes which not only have a pleasing appearance, but for the benefit of prospective customers, differentiate vehicles using those lighting schemes from other vehicles.

Since LEDs draw relatively little current, can last the life of a vehicle, illuminate almost instantaneously and produce little heat; LEDs are of interest as automotive lighting arrangements evolve. An attractive and distinct appearance is important for LED lamps located on the rear of the vehicle because drivers necessarily focus most of their attention on the rear surface of vehicles in front of them. This is because tail lamps of preceding vehicles indicate the presence of preceding vehicles at night, and brake, turn and hazard lamps at any time caution following vehicles.

Ambient sunlight is a consideration when designing automotive lighting because ambient sunlight can obscure signal lamp functions when reflected therefrom. Since individual LEDs are typically not as bright as individual incandescent bulbs currently used as signal lamps on automotive vehicles, the reflection of ambient sunlight from signal lamps is a concern.

SUMMARY OF THE INVENTION

In view of the aforementioned considerations, the present invention is directed to an automotive lamp comprising an array of light emitting diodes (LEDs) supported within the lamp. A bezel having a dark surface for absorbing visible light from external sources is positioned adjacent to the LEDs. The dark surface of the bezel has a high gloss finish or other reflective area at least adjacent the LEDs to reflect light from the LEDs, while the dark surface absorbs visible light from external sources. A lens of light transmitting material covers the array of LEDs.

In a further aspect of the invention, the dark surface is substantially black and the lens is clear.

In another aspect of the invention, the automotive lamp is a rear combination lamp assembly including a first array of LEDs which emit red light to function both as a tail light and as a brake light. The rear combination lamp assembly further comprises a second array of LEDs that in one embodiment emit amber light to provide turn and emergency signals which flash. A bezel surrounds the LEDs and is substantially black in color to absorb incoming light from exterior sources, such as sunlight, and includes a gloss finish to reflect light rearwardly from the LEDs. The bezel is mounted in a housing and a lens is positioned over the bezel and the arrays of LEDs.

In a preferred arrangement of the LEDs within the rear combination lamp assembly, the LEDs are arranged in vertical columns and at least a rearwardly facing reflector is positioned adjacent to the columns of LEDs.

In a preferred embodiment of energizing the LEDs, the LEDs of the first array are connected to a power supply which is connected with both a road light control system and a brake system in a vehicle. The power supply has a first mode of a reduced duty cycle for illuminating the LEDs of the first array only as taillights, and has a second mode activated by the braking system for delivering current at a higher percentage of the duty cycle to the LEDs of the first array. This illuminates the LEDs of the first array more brightly then when used as tail lights in order to provide brake lights. In still a further aspect of the invention, the power supply is connected to the second array of LEDs that emit flashing amber or red light and provides current thereto at a higher percentage of the duty cycle to contrast with the tail lights provided by the first array, as well as to be visible in conjunction with the second array, if the first array is brightly lit indicative of the vehicle's brakes being applied.

In still another aspect of the invention, the aforedescribed automotive lamp is used as a center, high mounted, stop lamp (CHMSL) comprising an array of red light emitting LEDs surrounded by a bezel which is substantially black in color to absorb incoming light from exterior sources while having a gloss finish providing reflector elements adjacent to the LEDs to reflect light from the array of red LEDs rearwardly. The bezel is mounted by a housing and a lens is positioned over the bezel and the array of red LEDs.

In further aspects of the CHMSL the red LEDs are arrayed in a line and the lens is clear.

In still another aspect of the invention the aforedescribed automotive lamps are utilized in combination in an arrangement of rear signal lamps on an automotive vehicle.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
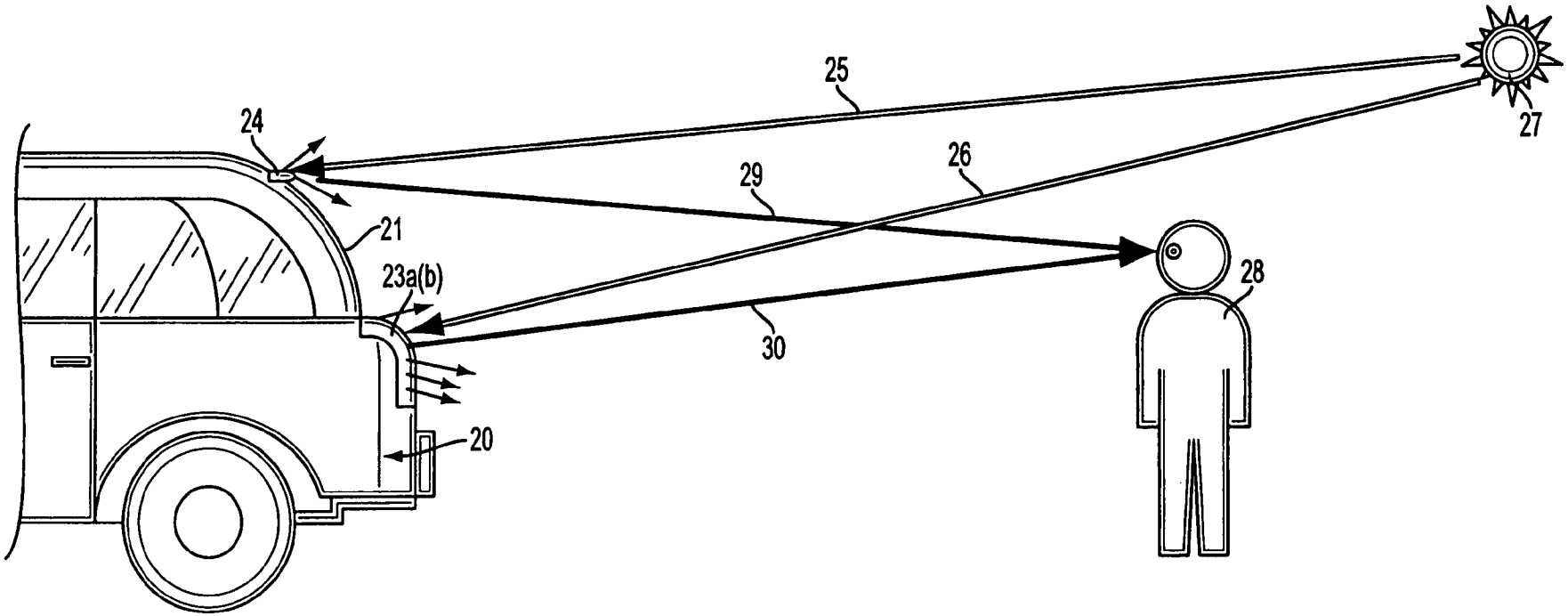
FIG. 1 is a schematic view illustrating light from the sun illuminating the rear of an automotive vehicle.

Referring now to FIG. 1 there is shown an automotive vehicle 20 having a rearwardly facing area 21 on which is disposed a pair of rear combination lamps 23*a*(*b*) and a center high mount stop lamp (CHMSL) 24. The pair of rear combination lamps 23*a*(*b*) and the CHMSL 24 are dark in color so as to not reflect exterior light rays, such as light rays 25 and 26 from an external source such as the sun 27, back to an observer 28 in a following vehicle. This is because dark objects absorb rather than reflect visible light. Since the rear combination lamps 23*a*(*b*) and CHMSL 24 absorb the externally emitted light rays 25 and 26, light rays 29 and 30 emitted by the rear combination lamps and CHMSL are not obscured by the light rays 25 and 26, and are thereby clearly visible to the observer 28. As will be explained hereinafter, this is accomplished by having dark surfaces of the lamps 23*a*(*b*) and 24 black, or substantially black in color, with a glossy surface, so that when the lamps are illuminated, they are not obscured by exterior light sources, such as light from the sun 27 or from other sources such as headlights of following vehicles.

Figure 2:
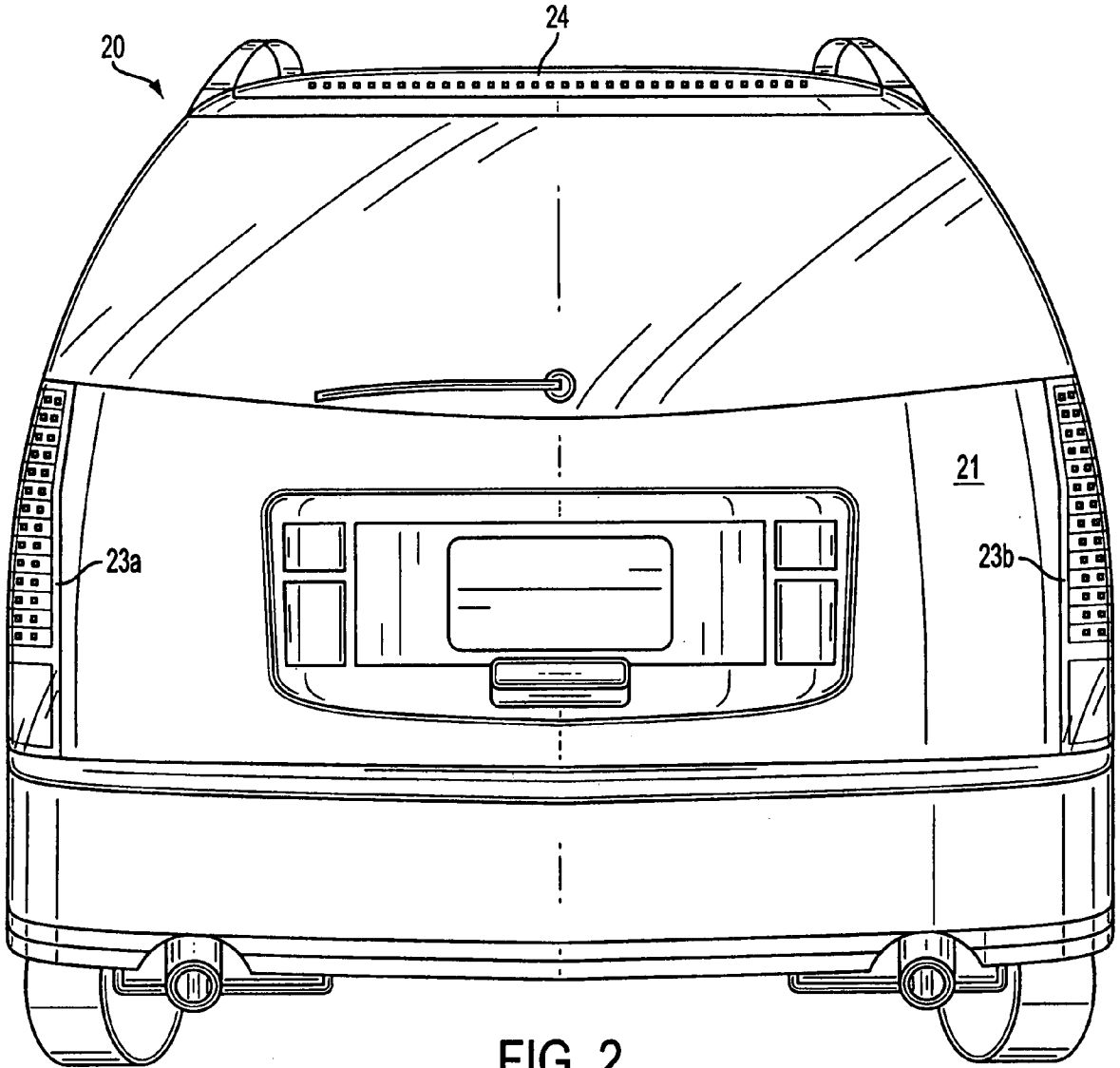
FIG. 2 is a rear view of the automotive vehicle of FIG. 1.

Referring now to FIGS. 2–5 where the rear area 21 of the vehicle 20 is shown, FIG. 2 shows the vehicle as it appears to a following driver in normal daylight. In FIG. 2, the rear combination lamps 23*a* and 23*b* and the CHMSL lamp 24 are not illuminated, whereas in FIG. 3, the rear combination lamps 23*a* and 23*b* are illuminated as tail signal lights 31*a* and 31*b* (preferably red in color) when the vehicle is traveling at night or twilight, in fog or in any other situation, such as with a group of other vehicles (convoy), where tail lights of vehicles are illuminated.

Figure 3:
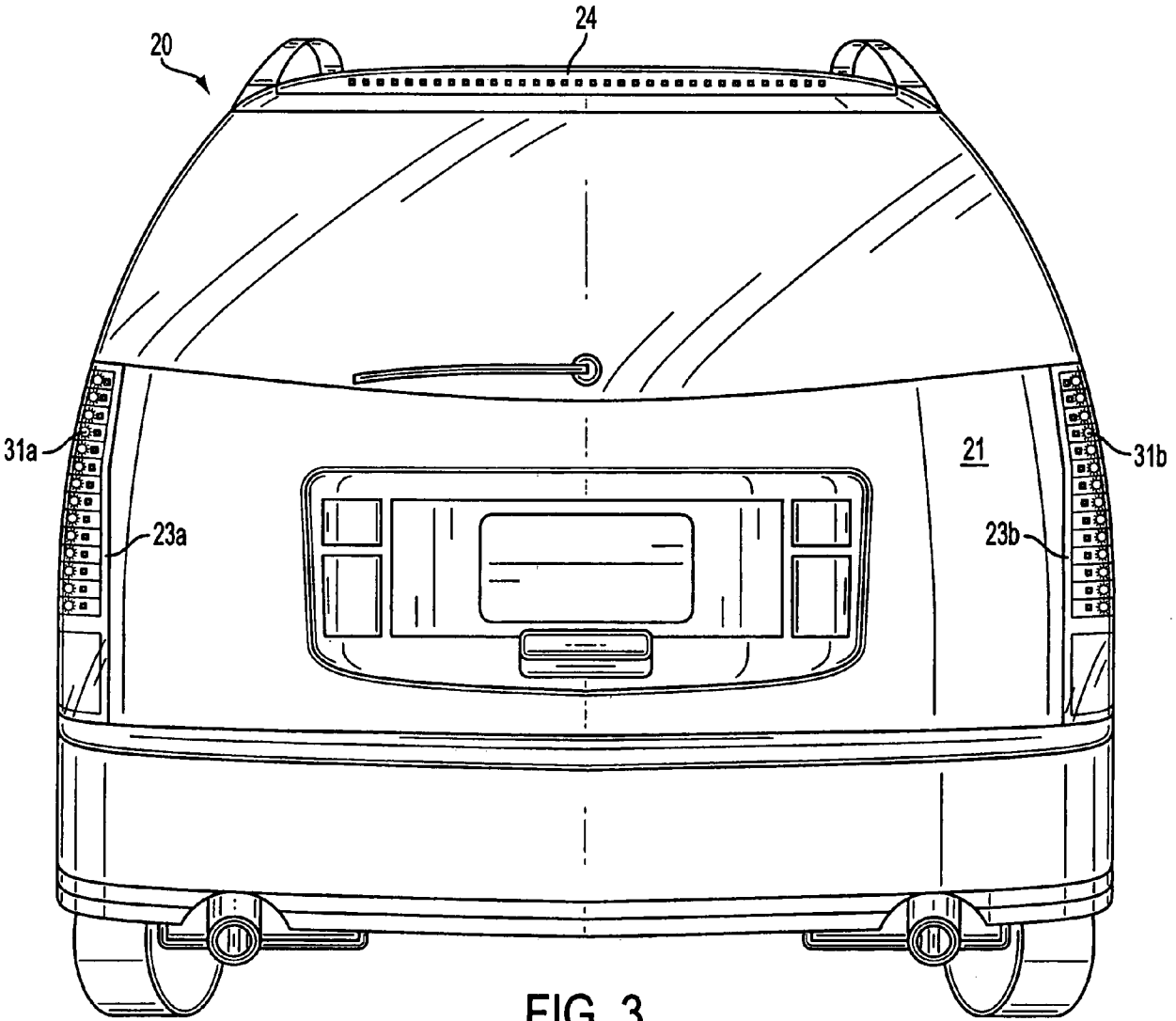
FIG. 3 is a rear view similar to FIG. 2 but showing tail lamps of the automotive vehicle illuminated.
Figure 4:
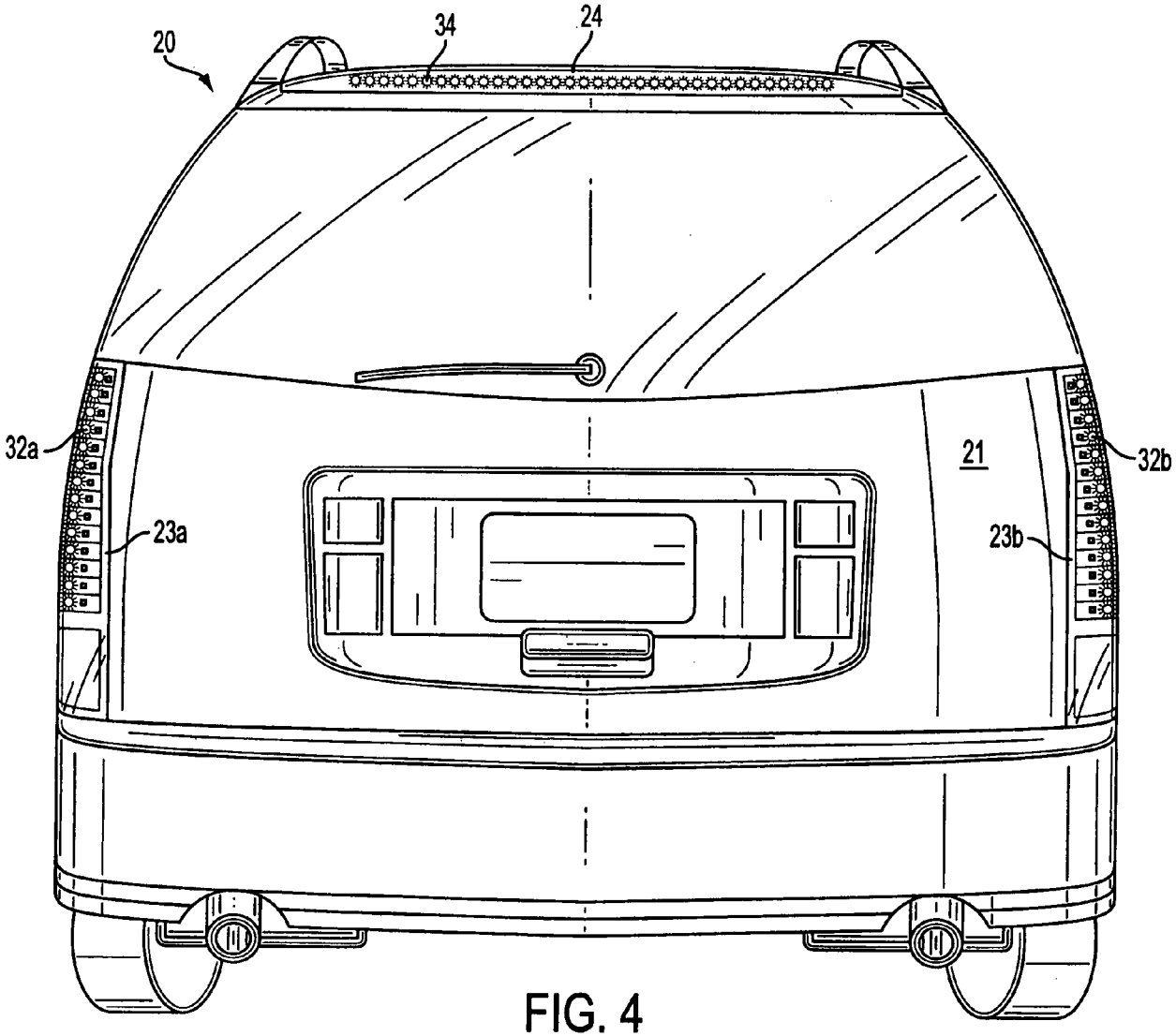
FIG. 4 is a view similar to FIGS. 2 and 3 but showing stop signals illuminated.

In FIG. 4, red signal stop lights 32*a* and 32*b* are substantially brighter than the red signal tail lights 31*a* and 31*b* of FIG. 3, notifying a following vehicle that brakes have been applied in the vehicle 20. In addition to illuminating the red signal stop lights 32*a* and 32*b* in the combination lamps 23*a* and 23*b*, respectively, a red signal stop light 34 in the CHMSL 24 is illuminated. The red signal stoplights 32*a*,32*b* and 34 are substantially brighter than the red signal tail lights 31*a* and 31*b*, providing a contrasting stop signal to following vehicles.

Figure 5:
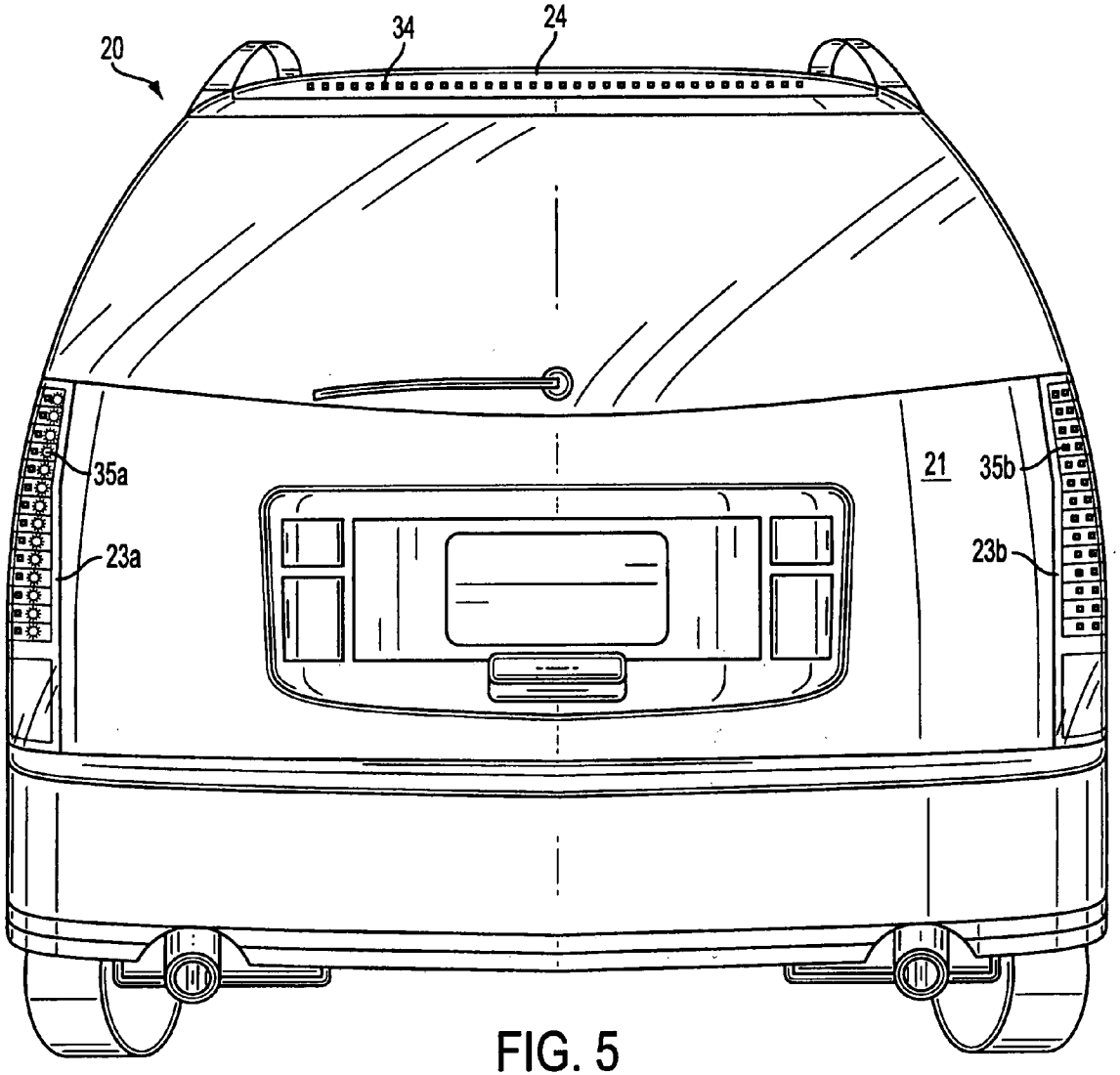
FIG. 5 is a view similar to FIGS. 2–4 but showing a left turn signal illuminated.

Referring now to FIG. 5, a left turn signal is indicated by the rear combination lamp 23*a* as a preferably amber (or red) turn signal light 35*a* which flashes. While "amber" is a required color for some turn signals in jurisdictions, such as the European Union; "red" or "white" is acceptable in other jurisdictions. For emergency vehicles "orange" or "blue" lights are employed and for funerals "violet" lights are also used in various ways. For conventional vehicles the general practice is to have red lamps for tail, stop and rear fog lights; amber or red lamps for turn and hazard signals, and white lamps for backing lights Since the turn signal light 35*a* both flashes and is bright, it contrasts with both the tail signal lights 31*a* and 31*b* and the stop signal lights 32*a* and 32*b*. If a hazards situation is being conveyed from the driver of the vehicle 20 to other drivers, then the turn signal light 35*a* flashes in unison with a turn signal light 35*b*.

Figure 6:
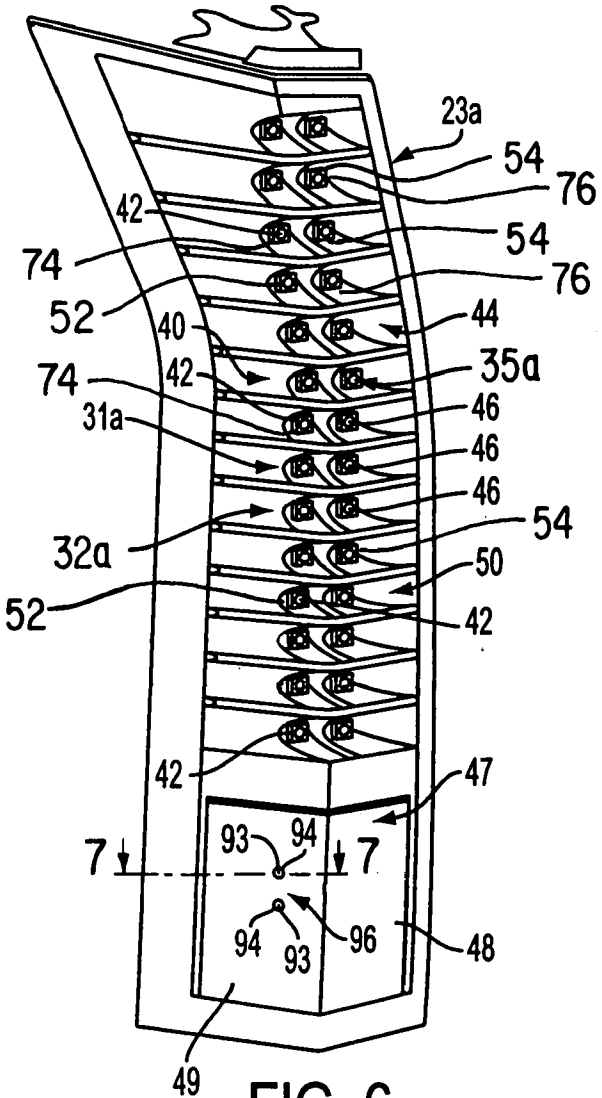
FIG. 6 is a perspective view of a rear combination lamp configured in accordance with the principles of the present invention.

Referring now to FIG. 6 one of the rear combination lamps 23*a* is shown, the other rear combination lamp 23*b* being a reverse image thereof. As is seen in FIG. 6, both the tail signal light 31*a* and the stop light signal source 32*a* are provided by a first array 40 of first LEDs 42 that emit red light. The turn signal light 35*a* is provided by a second array 44 of second LEDs 46 that preferably emit either flashing amber or flashing red light. In the embodiment of FIGS. 6 the first array 40 of first LEDs 42 and the second array 44 of second LEDs 46 are linear and are arranged in vertical columns to provide illumination proximate the vertical edges of the rear area 21 of the vehicle 20 (see also FIGS. 2–5). Beneath the two columns formed by the first and second arrays 40 and 44 of the LEDs 42 and 46, respectively, is a passive reflector 47 having a rear panel 48 and a side panel 49. The rear panel 48 is primarily visible from the rear area 21 of the vehicle 20 and the side panel 49 primarily visible from the side of the vehicle.

The LEDs 42 and 46 are surrounded by a bezel 50 which is dark in color to absorb rather than reflect exterior light sources such as sunlight (or following headlights), whereby the arrays of LEDs 40 and 44 are not obscured by reflected light rays from exterior light sources (see FIG. 1) when viewed by a following driver. Preferably, the bezel 50 is black or substantially black so that substantially all of the light rays 25 and 26 from an external source such as the sun 27 (see FIG. 1) are absorbed, however the bezel 50 has a high gloss surface at least in areas such as areas 52 and 54, which are directly adjacent to and extend obliquely with respect to the LEDs 42 and 46. Since at least these surfaces 52 and 54 of the bezel 50 are glossy, these surfaces reflect portions 56 and 58 of light emitted by the LEDs 42 and 46, respectively. Portions of emitted light which do not reflect from the glossy surfaces 52 and 54 of the bezel 50 are directed rearwardly in a direct line of sight to the following observer. By stepping the second array 44 of LEDs 46 with respect to the first array 40 of LEDs 42, there is less interference between the stop signal light 32*a* and turn signal 35*a*emitted from the LEDs 42 and 46, respectively. The portions 52 of the bezel 50 adjacent to the LEDs 42 are above and below the LEDs 42 so as to reflect substantially all of the laterally emitted light from the LEDs 42 back toward the following vehicle. At least some of the light from the LEDs 42 emits laterally, providing at least some side illumination for the rear combination lamps 23*a* and 23*b*.

The bezel 50 is preferably made of black polycarbonate and the reflective surfaces 52 and 54 may either be at least glossy portions of the black polycarbonate or may be in the shape of small, non-metalized reflector elements surrounding each of the LEDs 42 and 46. In the preferred illustrated embodiment the entire bezel is molded of black polycarbonate with a continuous glossy surface molded therewith.

The bezel 50 is attached to a housing 70 by a pair of metal push-in clips and at least one screw utilizing a rubber sealing gasket (neither of which is shown) so that the bezel is structurally stable with respect to the housing. In a preferred embodiment, the LEDs 42 project through openings 74 in the bezel 50 and the LEDs 46 project through openings 76 in the bezel, the openings 74 and 76 being adjacent the reflective surfaces 52 and 54 of the bezel.

The first array 40 of LEDs 42 is mounted on a stamped metal circuit 80 that is press fitted or otherwise attached to the back surface of the bezel 50. The second array 44 of LEDs 46 is attached to a stamped metal circuit that is also press fitted or otherwise attached to the back surface of the bezel. Alternatively, the stamped metal circuits are attached to surface of the housing.

Disposed over the arrays 40 and 46 of LEDs 42 and 46 is a lens 90. The lens 90 is preferably made of crystal clear (non-colored), medium impact, acrylic plastic having a black acrylic frame around the entire periphery of the lens. The frame is preferably molded integrally to the lens and the combination of the lens and the frame are adhered to the housing 70 using a two-part polyurethane adhesive 91 to combine the housing, lens and lens frame in an integral, closed structure protecting the LEDs 42 and 46. The housing 70 is attached removably to the rear of the vehicle 20 (FIGS. 1–5) in a conventional manner by using, for example, screws or bolts to mount the rear combination lamp 23*a* on the vehicle, the rear combination lamp 23*b* being generally configured and mounted on the vehicle in the same manner.

Figure 7:
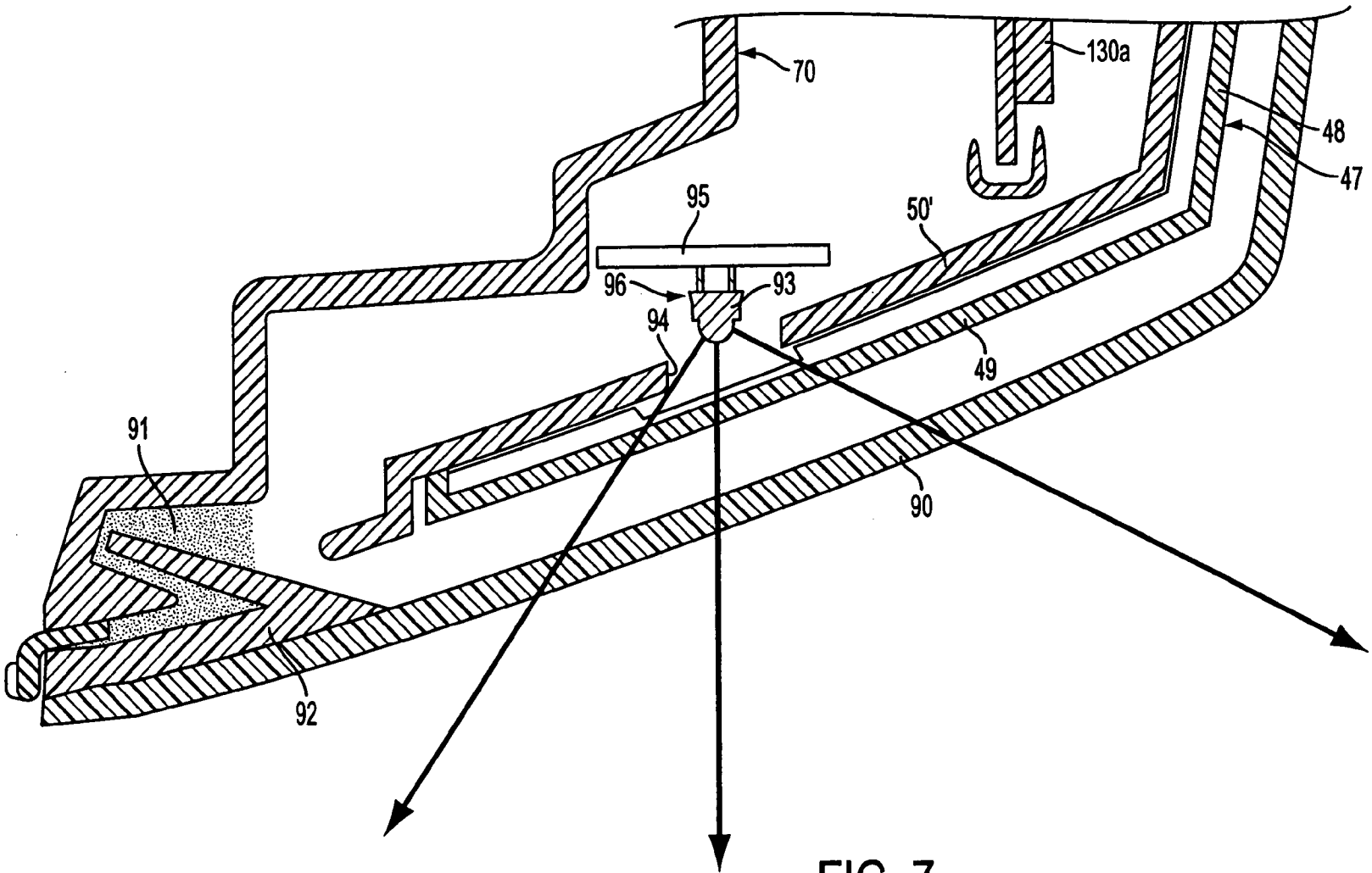
FIG. 7 is an elevation taken along line 7—7 of FIG. 6 showing optional side marker illumination.

As is seen in FIG. 7, for certain markets, red side marker LEDs 93 are required. In these situations, the bezel 50' is provided with an additional opening 94 and the LEDs 93 are supported in the housing 70 by a printed circuit board 95. Preferably, a pair of LEDs 93 provide a third array 96 of LEDs in each of the rear combination lamps 23*a* and 23*b* to provide side marker illumination for the two rear combination lamps. In a preferred embodiment, the LED or LEDs 93 are mounted to project light through a light transmitting portion of the side marker reflective panels 49 of each rear combination lamp 23*a* and 23*b*.

Figure 8:
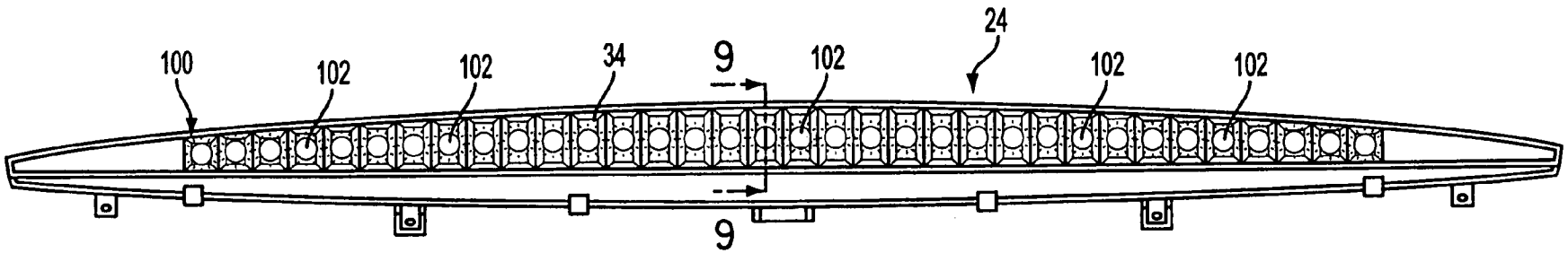
FIG. 8 is a rear view of a center, high mounted, stop lamp (CHMSL) configured in accordance with principles of the present invention.
Figure 9:
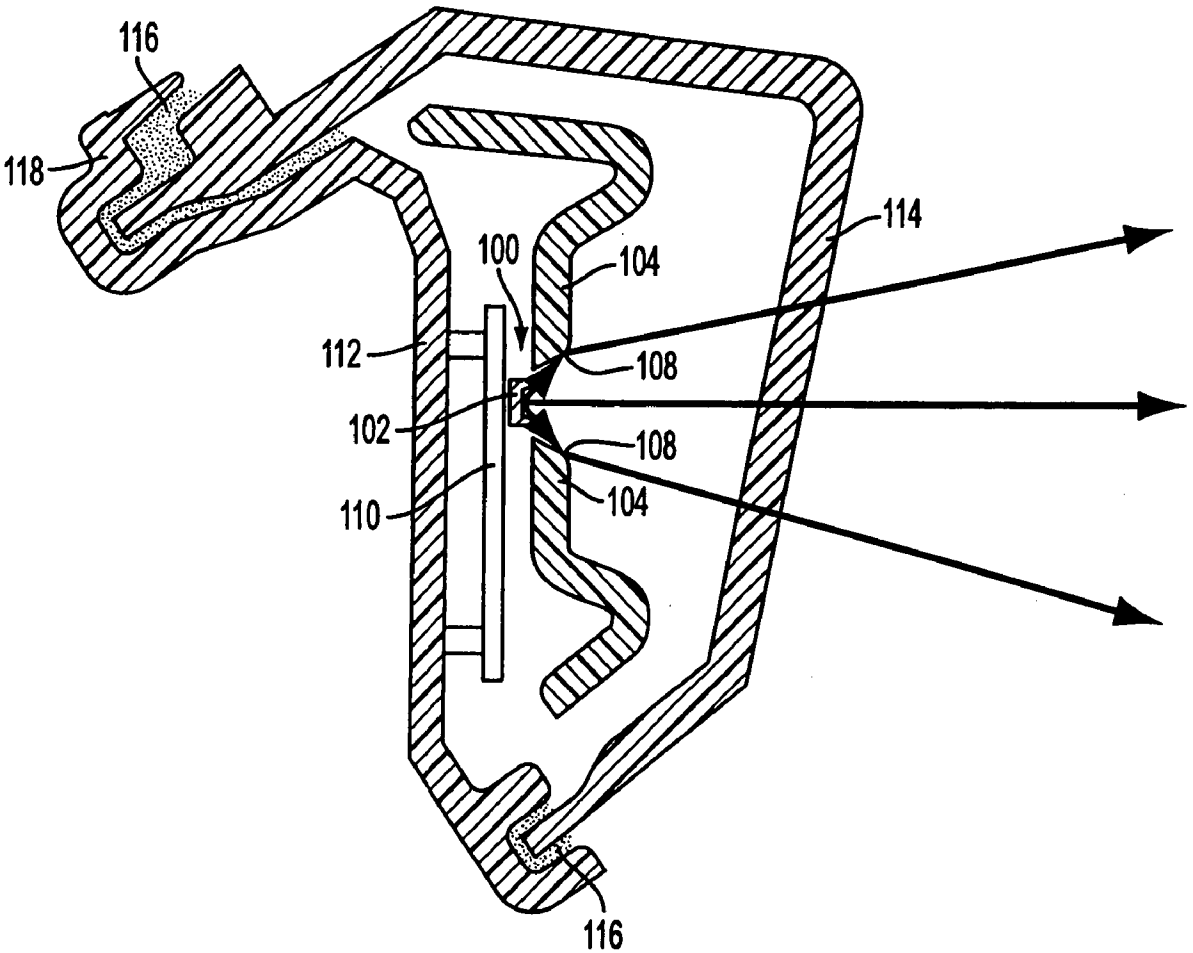
FIG. 9 is an elevation taken along line 9—9 of FIG. 8.

Referring now to FIGS. 8 and 9 where the center, high-mounted stop lamp (CHMSL) 24 is shown in isolation, it is seen that the stop signal light 34 of the CHMSL is comprised of an additional array 100 of individual red LEDs 102. In the illustrated embodiment there are 34 LEDs. While a linear array 100 of LEDs 102 is a preferred arrangement of a CHMSL for a vehicle such as an SUV, this third array 100 of LEDs 102 may be arranged in other configurations, such as lines of LEDs arranged one above the other, or in any other arrangement conveying a signal to a following driver to "stop."

As is seen in FIG. 9, the additional array 100 of LEDs 102 providing the CHMSL signal light 34 cooperate with a bezel 104 that has openings 106 therein through which red light from the LEDs passes. The bezel 104 is of a dark material which absorbs exterior light such as ambient sunlight or light from a following headlight, but has reflective surfaces 108 at least adjacent the LEDs 102. In a preferred embodiment, the bezel 104 is made of a dark plastic, such as black polycarbonate, having a glossy surface which provides the reflective surfaces 108 at least adjacent each LED 102. The LEDs 102 are mounted on a circuit board 110 positioned behind the bezel 104, the circuit board being affixed to a housing 112. The housing 112 is preferably made of a plastic material and supports a clear plastic lens 114 preferably made of an acrylic material. The clear plastic lens 114 preferably has a black acrylic frame. The clear plastic lens 114, which is preferably a crystal clear acrylic, is bonded to the housing 112 with a two-part polyurethane adhesive 116 to provide a permanently closed integral structure that protects the additional array 100 of red LEDs 102 for the life of the CHMSL 24.

Figure 10:
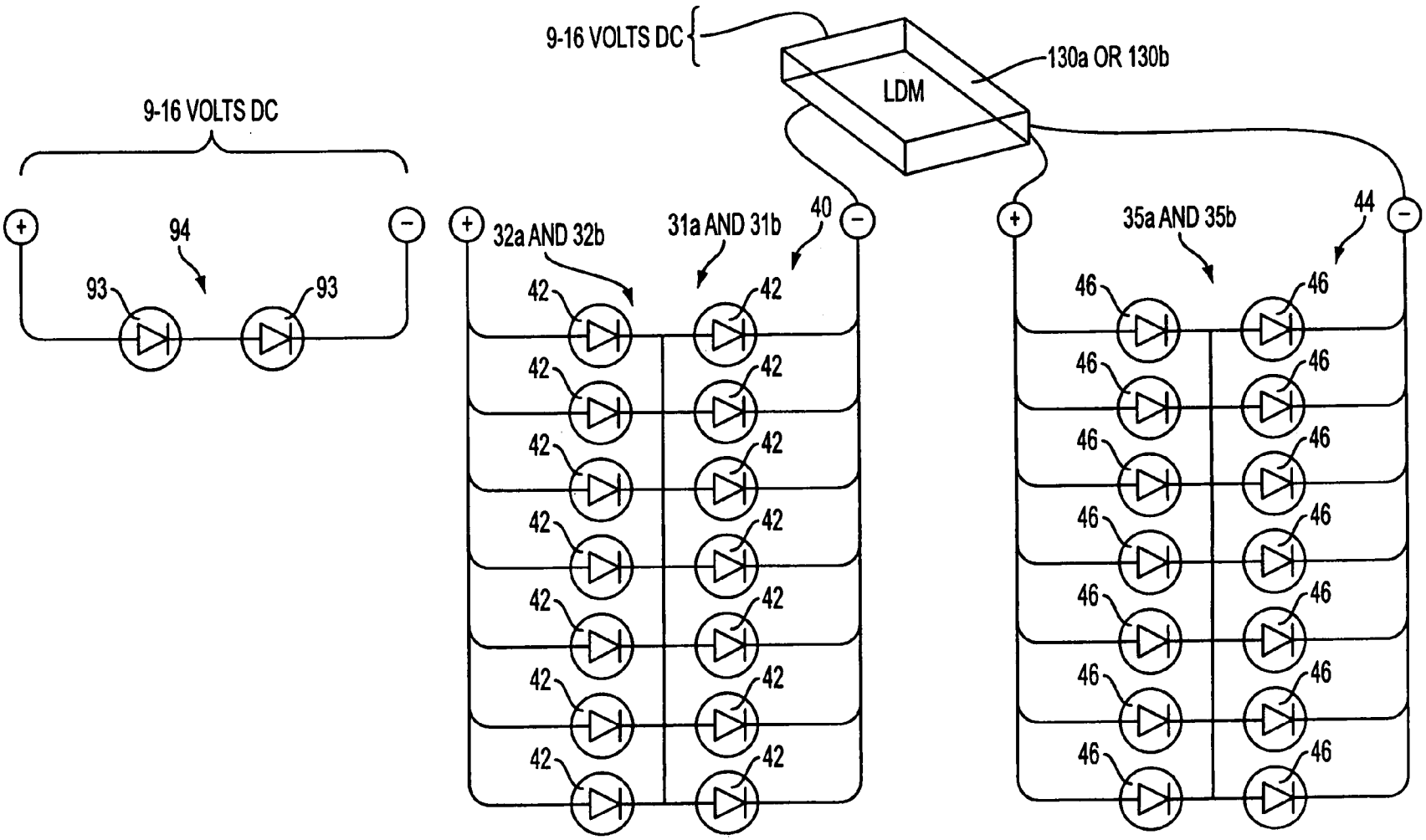
FIG. 10 is a schematic diagram showing a power supply arrangement used with each of the rear combination lamps of FIGS. 2–5, shown in FIG. 6.

Referring now to FIG. 10 there is shown a power supply, which is referred to in the art as an LED drive module or an LDM. An LDM 130*a* is mounted in the housing 70 of the left rear combination lamp 23*a* and an LDM 130*b* is mounted in the housing 70 of the right rear combination lamp 23*b*. The LDM modules 130*a* and 130*b* use constant vehicle current at 9–16 volts DC. When the outboard lights 31*a* and 31*b* (see FIG. 3) are functioning as taillights, the associated LDMs 130*a* and 130*b* are operating in a first mode at a 5% duty cycle to provide current to the red LEDs 42 of the first array 40 in each of the rear combination lamps 23*a* and 23*b*. Consequently, the red LEDs 42 emit light at a reduced intensity when in the first mode.

When the brake pedal of the vehicle 20 is pressed, the LDMs 130*a* and 130*b* change to a second mode during which the duty cycle is increased, preferably to a full duty cycle, which substantially brightens the red LEDs 42 in both rear combination lamps 23*a* and 23*b*, signaling a following driver that brakes have been applied in the vehicle 20.

The CHMSL light 34 is not modulated by the LDMs 130*a* and 130*b*, but is connected directly to the DC electrical system through a brake pedal detector and is illuminated immediately when the brake pedal is pressed (not shown) with current preferably at a full duty cycle, so that there are three rearwardly facing brake signal lights 32*a*,32*b* and 34 (see FIG. 4) displayed to following vehicles when the brake pedal in vehicle 20 is pressed.

The rear turn signal lights 35*a* and 35*b* always operate at a full duty cycle and are therefore always bright when flashing to indicate a left turn 35*a* or a right turn 35*b*, or when both are flashing in conjunction to indicate an emergency situation. The second LEDs 46 contrast with the first LEDs 42 in the first arrays 40 of the two rear combination lamps 23*a* and 23*b*. This contrast indicates to following vehicles that the vehicle 20 is turning or that the vehicle is aware of a hazardous condition. The turn signal lights 35*a* and 35*b* flash together when a caution switch in the vehicle 20 is activated to indicate the presence of a hazard to following drivers. The turn signal lights 35*a* and 35*b*, positioned inboard of the tail and stop signal lights 31*a* and 31*b*, are either red or amber and contrast markedly with the red tail lights 31*a* and 31*b* and stop lights 32*a* and 32*b* because the turn signal lights 35*a* and 35*b* continuously flash.

FIG. 10 is the actual circuit diagram of the illustrated embodiment. Although the LEDs 42 and 46 are each physically in single columns in the other drawing figures, other physical arrangements of the LEDs 42 and 46 may be used, such as but not limited to circular or polygonal arrangements.

As seen in FIG. 10, if a side marker function is utilized with the rear combination lamps 23*a* and 23*b*, then the LED 93 or the array 96 of LEDs 93 are preferably energized directly by the vehicles DC electrical system to always preferably illuminate at a full duty cycle. The CHMSL 24 is preferably also energized by 9–16 volt constant DC current at a full duty cycle taken directly from the electrical system of the vehicle 20.

The present invention is also applicable to front parking and directional signal lights configured in substantial similarity with the rear combination lights 23*a* and 23*b*, wherein turn signal LEDs have dark bezels with a reflective portion or element adjacent to the LEDs, so as to indicate turns when flashed one at a time to indicate turning direction, or in unison, to indicate an emergency condition. These lights may also be used as parking lights using amber or white LEDs with dark color bezels having reflective surfaces, such as the aforementioned glossy surfaces.

From the foregoing description, one skilled in the art can easily ascertain the essential characteristics of this invention, and without departing form the spirit and scope thereof, can make various changes and modifications of the invention to adapt it to various usages and conditions.

We claim:

1. A rear lamp assembly for an automotive vehicle comprising:

a first array of LEDs which emit red light to provide both a tail light and a brake light;

a second array of LEDs which emit amber or red light to provide a turn signal;

a bezel for surrounding the LEDs, the bezel being substantially black in color to absorb incoming light from exterior sources and having a gloss finish to reflect light from the LEDs:

a housing mounting the bezel; and a lens positioned over the bezel and arrays of LEDs, wherein the LEDs of the first array are connected to a power supply which is connected with both a road light control system and a brake system in the vehicle, the power supply having a first mode of a reduced duty cycle for illuminating the LEDs of the first array only as tail lights and having a second mode activated by braking system for delivering current at a higher percentage of the duty cycle to the LEDs of the first array illuminating the LEDs of the first array more brightly to provide brake lights.

2. The rear lamp assembly of claim 1 further including a connection from the power supply to the second array of LEDs which emit amber or red light, the power supply providing current at a higher percentage of the duty cycle to contrast with the first array.

3. The rear lamp assembly of claim 2 further including a third array of LEDs positioned at a side location of the lamp to provide a rear side marker light.

4. The rear lamp assembly of claim 3 wherein the third array of LEDs is energized by unmodified vehicle voltage.

5. The rear lamp assembly of claim 4 further including sidewardly facing and rearwardly facing reflectors on the bezel.

6. The rear lamp assembly of claim 1 further including a third array of LEDs positioned at a side location of the lamp to provide a rear side marker light.

7. An arrangement of rear signal lamps on an automotive vehicle, comprising:

a pair of rear lamps disposed on opposite sides of the automotive vehicle, each rear lamp having first and second arrays of LEDs, the first array of LEDs emitting red light to provide both a tail light and a brake light and the second array of LEDs emitting amber or red light to provide a turn signal;

a bezel within the lamp positioned adjacent to the LEDs, the bezel being dark in color to absorb incoming light from exterior sources and having a gloss finish to reflect light from the LEDs;

housings mounting the bezels of each rear lamp on the vehicle;

lenses positioned over each bezel and the array of LEDs of each rear lamp;

a center stop lamp positioned above the pair of rear lamps, the center stop lamp comprising an additional array of LEDs that emit red light, a bezel positioned adjacent to the LEDs of the additional array, the bezel being dark in color to absorb incoming light from exterior sources and having a gloss finish to reflect light from the LEDs of the additional array;

a housing mounting the bezel of the center stop lamp on the vehicle at a location above and between the pair of rear lamps;

a lens positioned over the housing and additional array of LEDs of the center stop lamp;

wherein the first and second arrays of LEDs in the pair of rear lamps are vertically extending arrays and wherein the additional array of LEDs in the center stop lamp is a horizontally extending array:

wherein the rear lamps each include at least one sidewardly facing LED positioned in a sidewardly facing portion of the bezel; and wherein the sidewardly facing LED in each rear lamp is a part of a third array including at least one other sidewardly facing LED; and a power supply system connected with both a road light control system and a brake system in the vehicle, the power supply having a first mode of a reduced duty cycle for illuminating the LEDs of the first array only as tail lights, and having a second mode activated by the braking system and turn signal system for delivering current at a higher percentage of the duty cycle to the LEDs of the first and second arrays for the illuminating the LEDs of the first array more brightly to provide brake lights and for illuminating the LEDs of the second array for providing turn signal lights;

the LEDs of the additional array in the center stop lamp being connected directly to vehicle current for illuminating the additional array at a level similar to that of the first away in the second mode; and the third array of LEDs being connected directly to vehicle current unmodified by the power supply.

8. An arrangement of rear signal lamps on an automotive vehicle, comprising:

a pair of rear lamps disposed on opposite sides of the automotive vehicle, each rear lamp having first and second arrays of LEDs, the first array of LEDs emitting red light to provide both a tail light and a brake light and the second array of LEDs emitting amber or red light to provide a turn signal;

a bezel within the lamp positioned adjacent to the LEDs, the bezel being dark in color to absorb incoming light from exterior sources and having a gloss finish to reflect light from the LEDs;

housings mounting the bezels of each rear lamp on the vehicle;

lenses positioned over each bezel and the array of LEDs of each rear lamp;

a center stop lamp positioned above the pair of rear lamps, the center stop lamp comprising an additional array of LEDs that emit red light, a bezel positioned adjacent to the LEDs of the additional array, the bezel being dark in color to absorb incoming light from exterior sources and having a gloss finish to reflect light from the LEDs of the additional array;

a housing mounting the bezel of the center stop lamp on the vehicle at a location above and between the pair of rear lamps;

a lens positioned over the housing and additional array of LEDs of the center stop lamp; and a power supply system connected with both a road light control system and a brake system in the vehicle, the power supply having a first mode of a reduced duty cycle for illuminating the LEDs of the first array only as tail lights and having a second mode activated by the braking system and turn signal system for delivering current at a higher percentage of the duty cycle to the LEDs of the first and second arrays for illuminating the LEDs of the first array more brightly to provide brake lights and for illuminating the LEDs of the second array more brightly to contrast with the first array when the first array is in the first mode, and the LEDs of the third array and the additional array being connected to vehicle current to illuminate the LEDs of the third and additional array at a level similar to that of the first array when the first array is in the second mode.

* * * * *